US007223177B2

(12) United States Patent
Tarbell

(10) Patent No.: US 7,223,177 B2
(45) Date of Patent: May 29, 2007

(54) POOL TABLE IMPROVEMENTS

(76) Inventor: Daniel E. Tarbell, 4119 Altapass Hwy., Spruce Pine, NC (US) 28777

( * ) Notice: Subject to any disclaimer, the term of this patent is extended or adjusted under 35 U.S.C. 154(b) by 0 days.

(21) Appl. No.: 11/118,102

(22) Filed: Apr. 30, 2005

(65) Prior Publication Data

US 2005/0282644 A1 Dec. 22, 2005

Related U.S. Application Data

(60) Provisional application No. 60/566,694, filed on Apr. 30, 2004.

(51) Int. Cl.
*A63D 15/00* (2006.01)
*A63F 9/24* (2006.01)

(52) U.S. Cl. ..... 473/30; 108/90

(58) Field of Classification Search ..... 473/30, 473/29, 33, 32, 1, 496; 273/309; 108/90
See application file for complete search history.

(56) References Cited

U.S. PATENT DOCUMENTS

| | | | | | |
|---|---|---|---|---|---|
| 864,292 | A * | 8/1907 | Cohen | 473/30 |
| 889,843 | A * | 6/1908 | Barrett | 473/30 |
| 1,036,238 | A * | 8/1912 | Hjort | 473/30 |
| 1,332,776 | A * | 3/1920 | Sultanaki | 108/90 |
| 1,528,287 | A * | 3/1925 | Ajello | 248/188.4 |
| 1,579,730 | A * | 4/1926 | Nelson | 473/30 |
| 2,755,088 | A * | 7/1956 | Allman | 473/30 |
| 3,811,673 | A * | 5/1974 | Baker | 473/31 |
| 4,056,266 | A * | 11/1977 | Gramstrup | 473/31 |
| 4,519,607 | A * | 5/1985 | Schill | 473/12 |
| 4,627,363 | A * | 12/1986 | Jones | 108/90 |
| 5,649,700 | A * | 7/1997 | Suh et al. | 473/496 |
| 6,132,320 | A * | 10/2000 | Spoerl et al. | 473/29 |
| 6,499,411 | B2 * | 12/2002 | Brown | 108/90 |
| 6,669,194 | B2 * | 12/2003 | Houston, Jr. | 273/118 R |

FOREIGN PATENT DOCUMENTS

| | | |
|---|---|---|
| GB | 2362328 A | 11/2001 |
| WO | WO 01/89347 | 11/2001 |

OTHER PUBLICATIONS

Results of the Partial International Search mailed on Jan. 13, 2006 in connection with PCT/US2005/014985.
International Search Report mailed on Mar. 21, 2006 in connection with PCT/US2005/014985.
Written Opinion of the International Searching Authority mailed on Mar. 21, 2006 in connection with PCT/US2005/014985.

* cited by examiner

*Primary Examiner*—Mitra Aryanpour
(74) *Attorney, Agent, or Firm*—Smith Moore LLP

(57) ABSTRACT

Pool table improvements including: (1) a quick change pool table cloth system including a snap on cloth; (2) a built in pool table level system including highly sensitive levels embedded into the pool table frame; (3) a pre-adjusted, push, pull slate frame leveling system including push and pull bolts for leveling and positioning a slate frame; (4) a seven bolt, bi directional, cushion/cap rail anchor system; (5) a U-shaped structural design; (6) tapered, self-taping, threaded flange inserts; and (7) a slate and frame movement system.

3 Claims, 13 Drawing Sheets

POOL TABLE IMPROVEMENTS

This application claims the benefit of U.S. Provisional Application No. 60/566,694 filed Apr. 30, 2004.

BACKGROUND OF THE INVENTION

The present invention is directed towards billiard tables, also known as pool tables, and more particularly, towards improvements to the standard pool table and pool table cover.

The game of billiards or pool is a centuries-old pastime that is played throughout the world. In order to effectively play the game, a quality constructed and assembled, and level pool table is required. Such quality pool tables include specially designed pool table covers that are precisely measured and stretched to created a desirable playing surface on the table. If either the construction or assembly of the pool table is shoddy, or if the pool table cover becomes worn, the quality of the game can be negatively impacted. Thus, there is a need in the art for improvements to the construction and assembly of pool tables, as well as to pool table covers.

BRIEF DESCRIPTION OF THE FIGURES

FIGS. 14A–14C are sectional views of a flange that may be used in accordance with an embodiment of the present invention.

DESCRIPTION OF THE PRESENT INVENTION

The present invention provides: (1) a built in quick change pool table cloth system; (2) a built in pool table level system; (3) a pre-adjusted, push, pull slate frame leveling system; (4) a seven bolt, bi-directional, cushion/cap rail anchor system; (5) a U-shaped structural design; (6) tapered, self-taping, threaded flange inserts; and (7) a slate and frame movement system.

Quick Change Pool Table Cloth System

This present invention provides a system for applying and changing a pool table cloth easily and quickly as compared to conventional methods. The system allows one to quickly change the cloth on a pool table without the use of nails or staples that permanently attach the cloth to the table.

Figure 1:
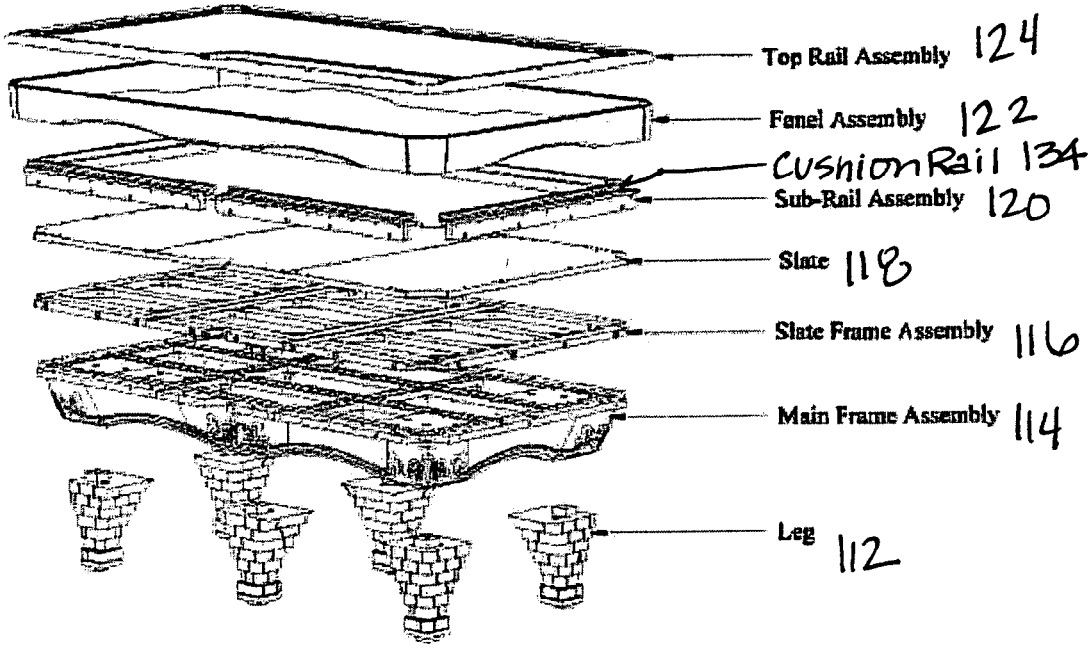
FIG. 1 is an exploded view of a pool table in accordance with an embodiment of the present invention.

As shown in FIG. 1, the quick change cloth of the present invention may be used on pool tables 100 that require very thick slate frames 116 for strength and mass to deaden the playing surface for fantastic play. These thick slate framed tables permit the introduction of female metal snaps used to precisely locate and hold the cloth on the pool tables.

Figure 2:
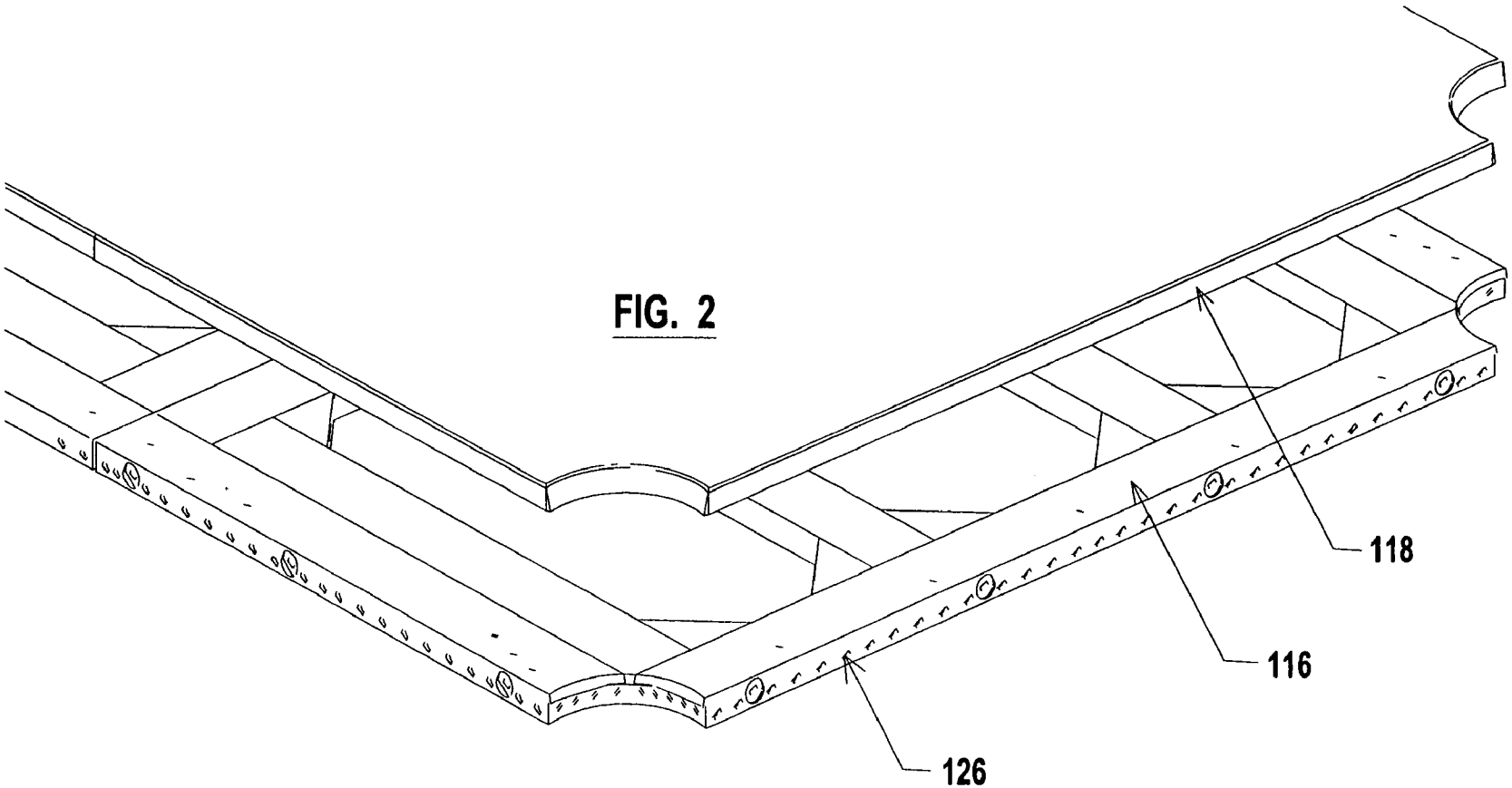
FIG. 2 is an exploded view of a pool table frame in accordance with an embodiment of the present invention.
Figure 3:
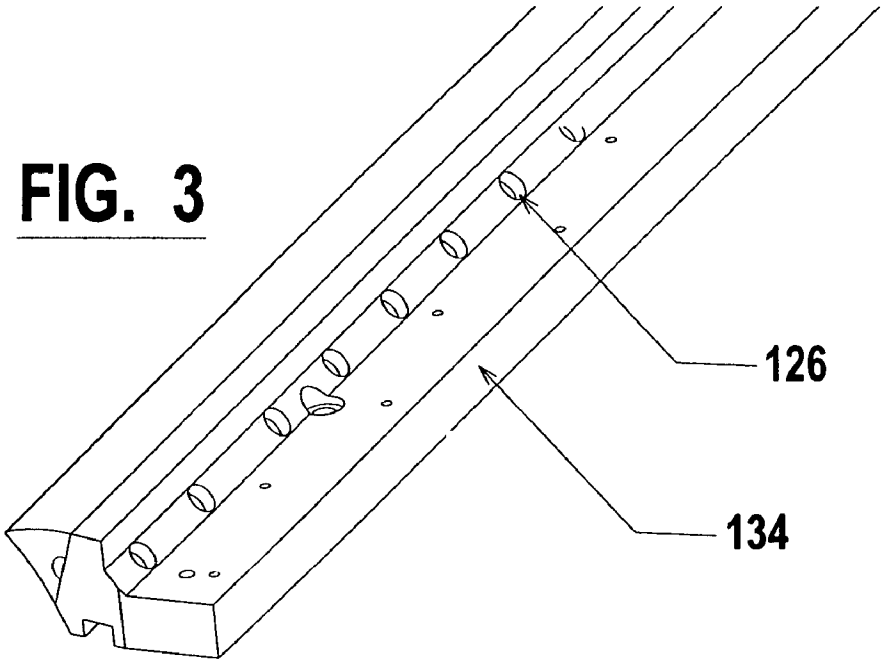
FIG. 3 is a perspective view of a cushion rail in accordance with an embodiment of the present invention.
Figure 4:
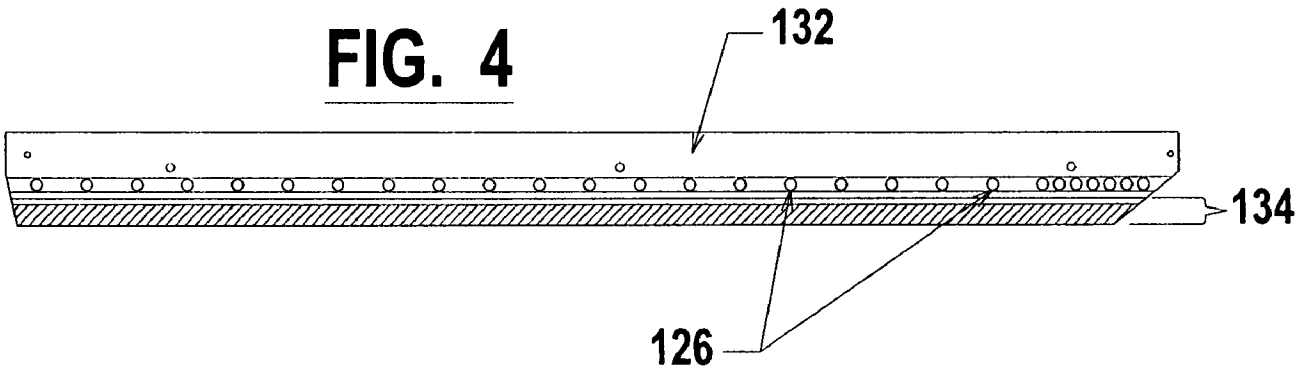
FIG. 4 is a bottom view of a cushion rail in accordance with an embodiment of the present invention.
Figure 5:
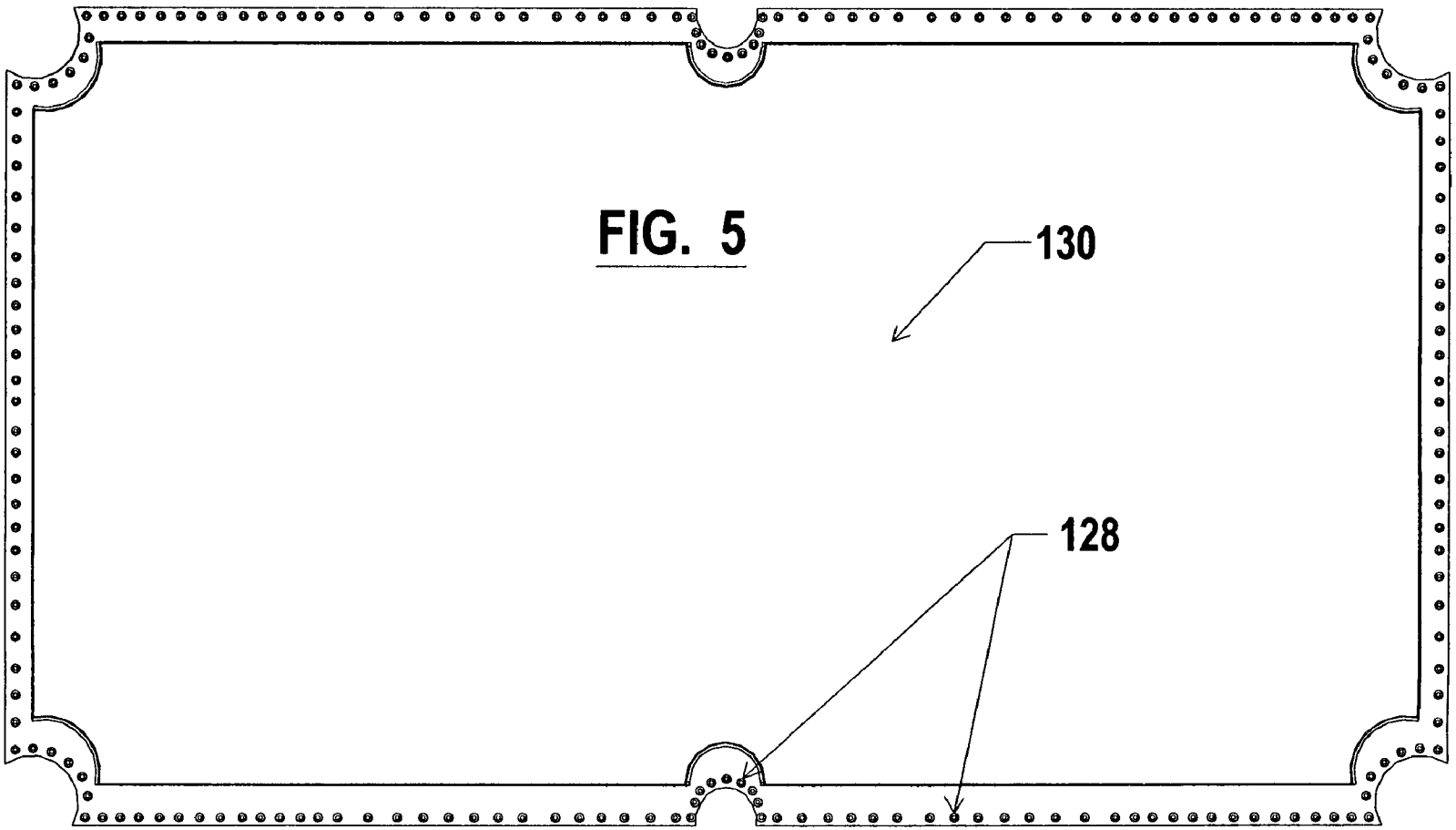
FIG. 5 is a top view of a table cloth in accordance with an embodiment of the present invention.

As shown in FIG. 2, the female metal snaps 126 are located in close proximity of each other in precision placement around the perimeter of the pool table slate frame's 116 sides and ends. The female metal snaps 126 are also located on the cushion rail 134 that is connected to the sub-rail assembly 120, as shown in FIGS. 3 and 4. Particularly, the female snaps 126 are imbedded on the inside of the cushion rail 134 and to the bottom of the cushion rail 134.

Male snaps 128 are provided on the pool table cloth 130, which snap tightly into the female snaps 126 in a mating engagement to achieve an anchoring system of the cloth 130 to the pool table 100. The male snaps 128 are mounted in the cloth 130 in the same relationship and spacing as the female snaps 126 in the slate frame 116 and the cushion rails 134. However, there is a special cloth stretching and marking of the cloth 130 that should be done before the snaps 128 are installed into the cloth 130. This is because the cloth 130 should be under tension while being used on the pool table 100.

Once the snaps 126, 128 are put into the pool table 100 and into the cloth 130, respectively, the cloth 130 may be laid over the slate 118 and the cushion rails 134 during assembly of the pool table 100. Then, the cloth 130 may be pulled into position and simply snapped into place. It should be understood that the present invention is not limited to the female snaps being embedded in the pool table frame and the male snaps being embedded in the cloth. Rather, the snap portions may be reversed and still be within the spirit and scope of the invention.

The quick change pool table cloth system as described above provides an advantage over prior art means for assembling a pool table cloth on a pool table. Particularly, it takes less time for a customer or pool table installer to apply the cloth in a professional manner, thus providing both a quick and easy method for changing the cloth. This means that non-professionals can install a cloth using the present system equally well as professional installers. This also saves money and time for the average purchaser of pool tables. The present invention also provides a easier way for customers to change the color of the cloth for a particular event instead of only replacing the cloth when it is worn out. Further, unlike prior art methods, the present invention does not require the use of nails or staples to apply the cloth to the table, which are bad for the cloth and bad for the pool table. Finally, the present invention's quick-change pool table cloth system provides for a more uniform and systematic stretching of the cloth to produce the best possible playing field for the pool table users.

Built in Pool Table Level System

The present invention further provides a system for quickly and accurately leveling a pool table that results in faster and easier setting up of the pool table, and ensures that the pool table is level when the installation is complete. This may be done without using any levels other than what is provided as built-in levels in the pool table components.

Figure 6:
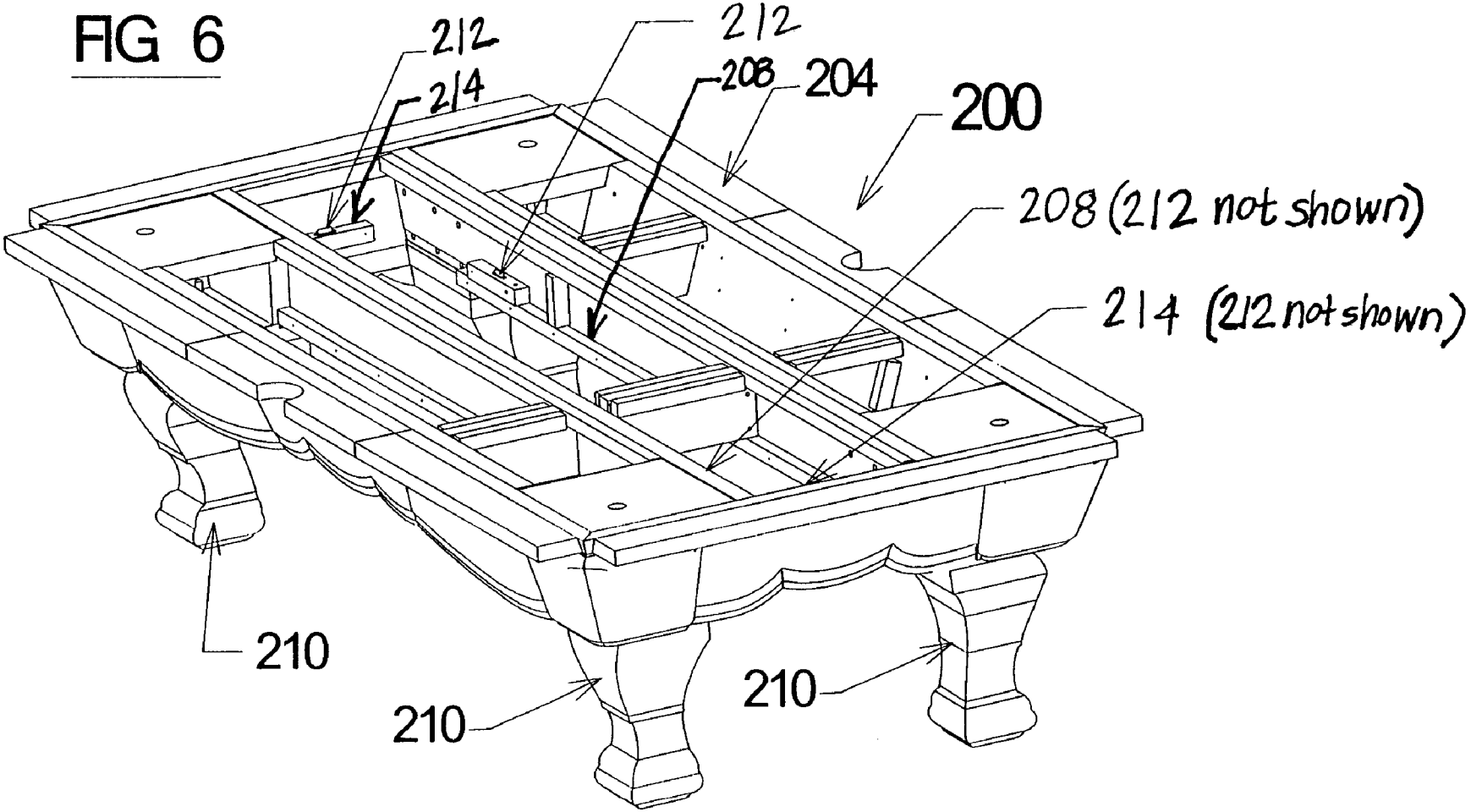
FIG. 6 is a perspective view of a pool table frame in accordance with an embodiment of the present invention.

As shown in FIG. 6, the pool table level system of the present invention preferably includes ultra high sensitivity levels that are mounted directly onto or into the pool table frame 204 itself while the pool table 200 is being built. Particularly, these levels are mounted permanently into the pool table frame 204 while the pool table 200 is in a state of being level as determined by highly accurate levels used during the manufacturing of the pool tables.

Figure 7:
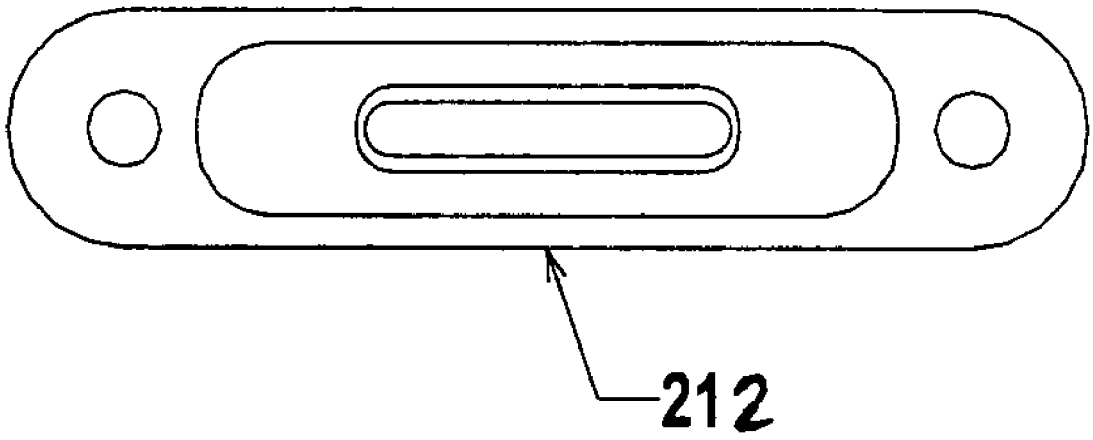
FIG. 7 is a top view of an exemplary level that is imbedded into a pool table frame in accordance with an embodiment of the present invention.

In a preferred embodiment, two of the ultra high sensitivity tube levels 212 are mounted into the base end rails 214 of the pool table frame 204 and two of the high sensitivity tube levels 212 are mounted into one end of each of the longitudinal beams 208 of the pool table base frame 204 (only one level 212 is shown in each of the base end rails 214 and the longitudinal beams 208 due to the perspective of FIG. 6). An exemplary tube type bubble level 212 is shown in FIG. 7. It should be understood, however, that any type of sensitive level that may be imbedded into the pool table frame 204 may be used and still fall within the spirit and scope of the present invention. It should also be understood that the levels 212 may be embedded into other rails of the pool table frame 204 in addition to or rather than the base end rails 214 and the base frame longitudinal beams 208, and still fall within the spirit and scope of the present invention.

Figure 8:
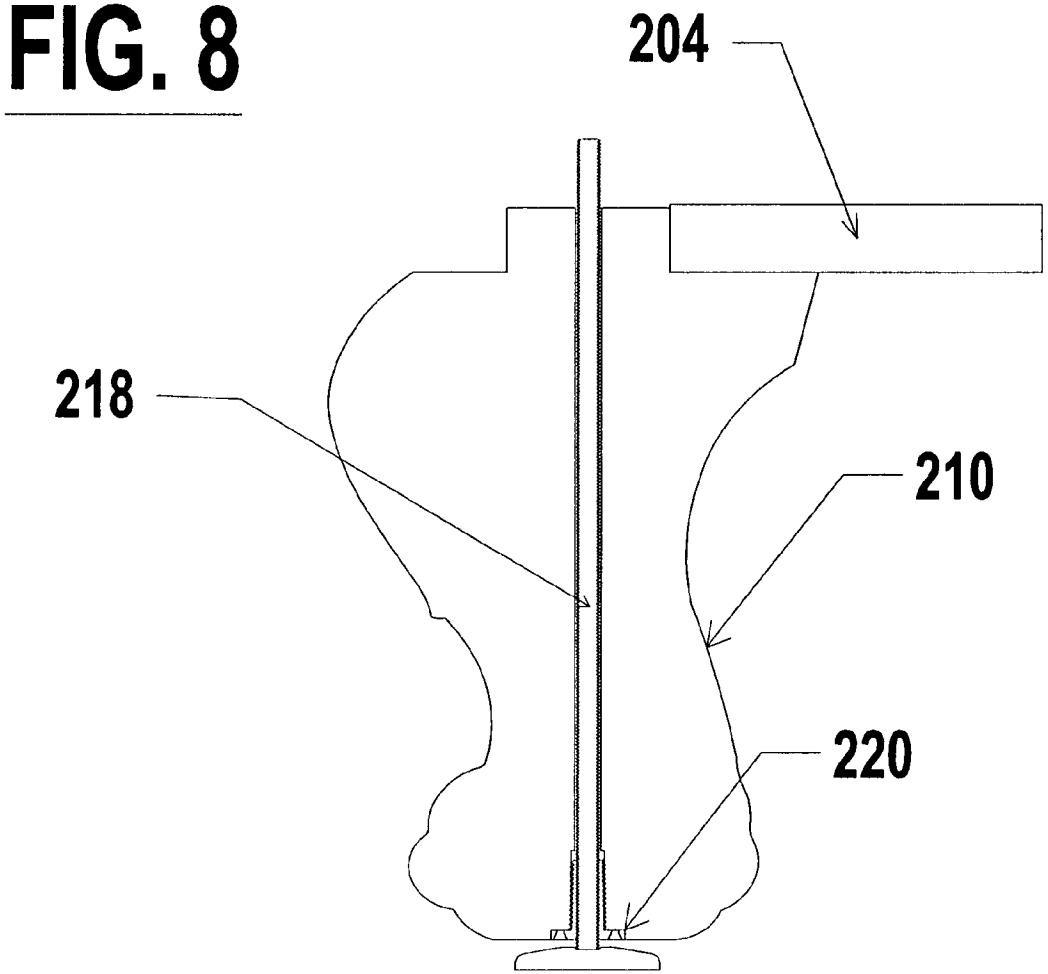
FIG. 8 is a cross-sectional view of a pool table leg in accordance with an embodiment of the present invention.

Even though the pool tables 200 are taken apart after assembly for shipping purposes, the built-in levels 212 always report a level condition when the pool table 200 is re-assembled and adjusted properly. More particularly, after the legs 210 have been re-assembled into the pool table frame 204 in the customer's care, the frame 204 is raised by means of using a threaded rod 218 and a threaded flange 220 insert set into the bottom of each leg 210, as shown in FIG. 8. Each threaded rod 218 is turned with a wrench until the height of the pool table is level as is reported by the tube levels 212 mounted in each base end rail 214.

When all of the legs 210 are leveled, one side to the other, by adjusting the leg 210 height to create a level plane using the tube levels 212 on the base end rails 214, the side to side leveling is complete. The tube levels 212 on the longitudinal beams 208 are then used to level the length of the table frame 204. This leveling is performed in the same manner as the tube levels 212 on the base end rails 214, except that both legs 210 of one end of the pool table are raised or lowered the same distance until both longitudinal beam 208 levels 212 report the same level condition. The result when the adjustments are complete is an ultra accurate level condition of the pool table 200.

The above-described built in level system provides many advantages over prior art pool table leveling systems. One of the biggest advantages is that the levels used are far more accurate than simple carpenters' levels typically used by installers to level pool tables. The sensitivity of the levels used in this invention is more than thirty times more sensitive and accurate than that of simple three or four foot long carpenters' levels. This means a far superior level condition of the pool tables can be reached when using this system.

Second, it does not take a lot of people to lift and raise a pool table in accordance with the present invention as it does when adding shims, or turning a leg adjuster, to reach a level condition as required when using prior art methods of leveling a pool table using a carpenters' level. Rather, a single individual with a wrench can level a pool table using the present invention. Further, the leveling performed in accordance with the present invention can be achieved without any back strain or injuries that are typically associated with lifting pool tables to level them using conventional methods. The present invention also ensures that a highly accurate level condition can be achieved in minutes as compared to hours using multiple people as done with prior art methods used to level a pool table properly. Therefore, a non-professional can adjust the height of and level a pool table using the present system as well as a professional pool table installer. In addition, if the floor on which a pool table is installed shifts, or if someone wants to move the pool table, the present invention allows for easy re-adjustment by simply looking at the high sensitivity levels, re-adjusting the leg height using a wrench to turn the threaded rod, and raising the table to the level condition reported by the levels built into the pool table.

Pre-adjusted, Push, Pull Slate Frame Leveling System

Figure 9:
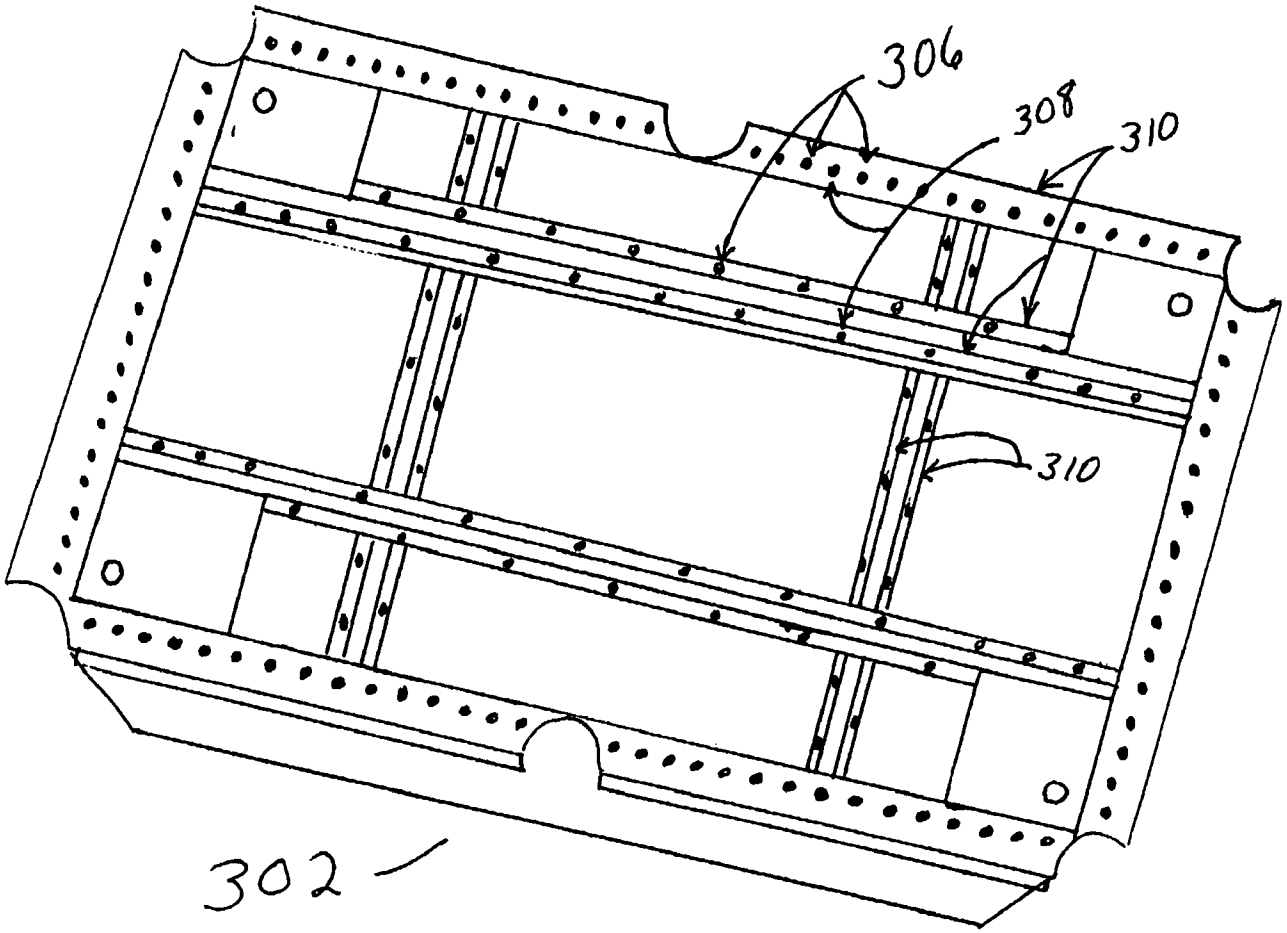
FIG. 9 is a perspective view of view of a slate frame in accordance with an embodiment of the present invention.
Figure 10:
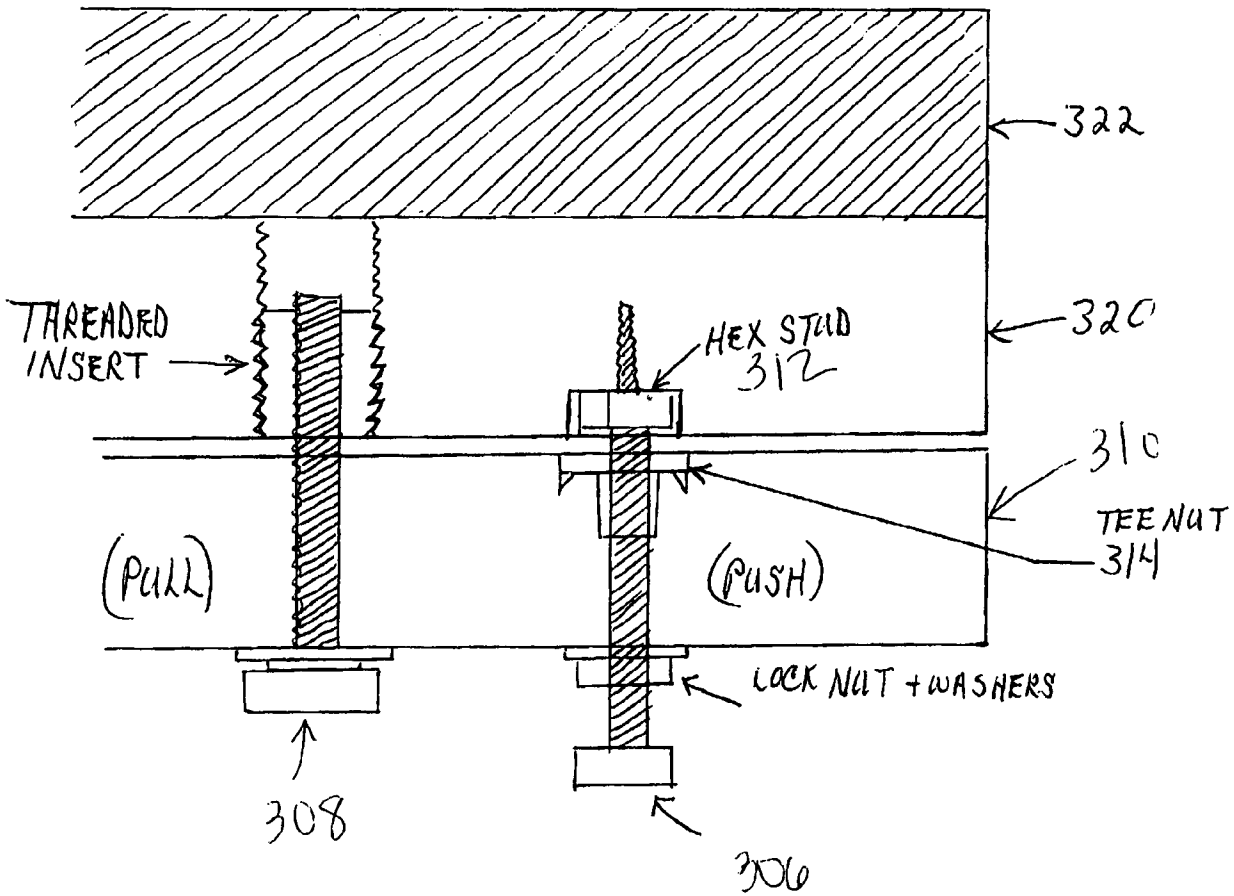
FIG. 10 is a cross sectional view of a pool table frame in accordance with an embodiment of the present invention.

The present invention further provides a system for pre-adjusting the slate frame and slate of a pool table to a flat, level condition between the different sections of slate and the pool table main frame during manufacturing of the pool table. Thus, the present invention allows for quick and easy line up of the slate for the customer or installer at the installation site. As shown in FIGS. 9 and 10, the system preferably includes dozens of push bolts 306 and pull bolts 308 built into the pool table main frame 302, that are pre-set to hold the slate frame 320 and slate 322 in the proper position to create a flat plane of the slate sections to create the level playing field of the pool table.

The push bolts 306 are located in the cleat rails 310 of the pool table main frame 304. The cleat rails 310 provide the support for the slate frame 320 and slate 322. The cleat rails 310 are bored vertically, and have a tee nut 314 on the topside for the push bolts 306. The push bolts 306 are threaded into the tee nut 314 from the bottom side of the cleat rail 310 allowing the adjustment of the bolt 306 extending through the tee nut 314 to dictate the elevation of the slate frame 320 above the bolt 306 and tee nut 314. Once the bolts 306 are adjusted properly making a level plane, the bolts 306 are preferably locked in place with hex nuts 312. As the slate 322 and slate frame 320 are in a flat level plane with the bolts 306 locked in position during manufacturing, the slate will always be in proper alignment.

When the pool table's slate frame 320 and slate 322 are disassembled and packed for shipment, the pre-set push bolts 306 remain in their adjusted state. When the pool table is re-assembled later the slate frame 320 and slate 322 again become flat and level resulting from the pre-adjusted push points of the bolts 306. This is also made possible by a reverse action of a similar number of pull bolts 308 placed in a similar manner as the push bolts 306. These pull bolts 308 create a pulling action that is opposite to the pushing action of push bolts 306 by bolting through the cleat rails 310 and threading into threaded inserts located in the slate frame 320. These pull bolts 308 draw the slate 322 and slate frame 320 to the push bolts 306.

This produces a pre-leveled condition that is repeatable, as the surface of the slate 322 is controlled by pushing and pulling it to a specified place. If any minor adjustments are needed, all that is required is the adjustment of the height of one of the pushing bolts 306 causing the slate to move up or down as desired to reach the desired result.

One of the prior art methods of adjusting the slate and slate frame is by adding shims under the slate or slate frame to raise the slate. This requires a lot of time and someone who is a professional pool table installer. The present invention, on the other hand, does not require a professional installer and puts the burden of the line up of the slate on the manufacturer of the pool table. This results in the consumer being able to quickly set up the pool table with ease and produces a flatter surface than is possible with the prior art means of using shims to adjust the plane of the surfaces.

Seven-Bolt, Bi-Directional Cushion/Cap Rail Anchor System

The present invention further provides a system that increases the strength of the bolting action that holds the cushion rails of a pool table in place and dampens the vibrations caused by balls banging into the cushion rails. The system includes a billiard table comprising a slate, a slate frame, a cushion rail, and a sub-rail assembly wherein the cushion rail assembly is bolted vertically to the slate and slate frame and horizontally to the sub-rail assembly.

More particularly, this embodiment of the present invention is more than simply adding more bolts than the prior art practice of bolting the cushion rail through the slate of the table. Rather, this invention accurately locates and bolts the cushion rail in place both vertically and horizontally, therefore producing a multiplied holding force as compared to the single direction of a typical three bolt system used on a single typical cushion rail. The alignment of the present system forces a predictable, highly accurate alignment of the cushion and cap rails with minimal, if any, effort on the part of the individual assembling the pool table.

Figure 11:
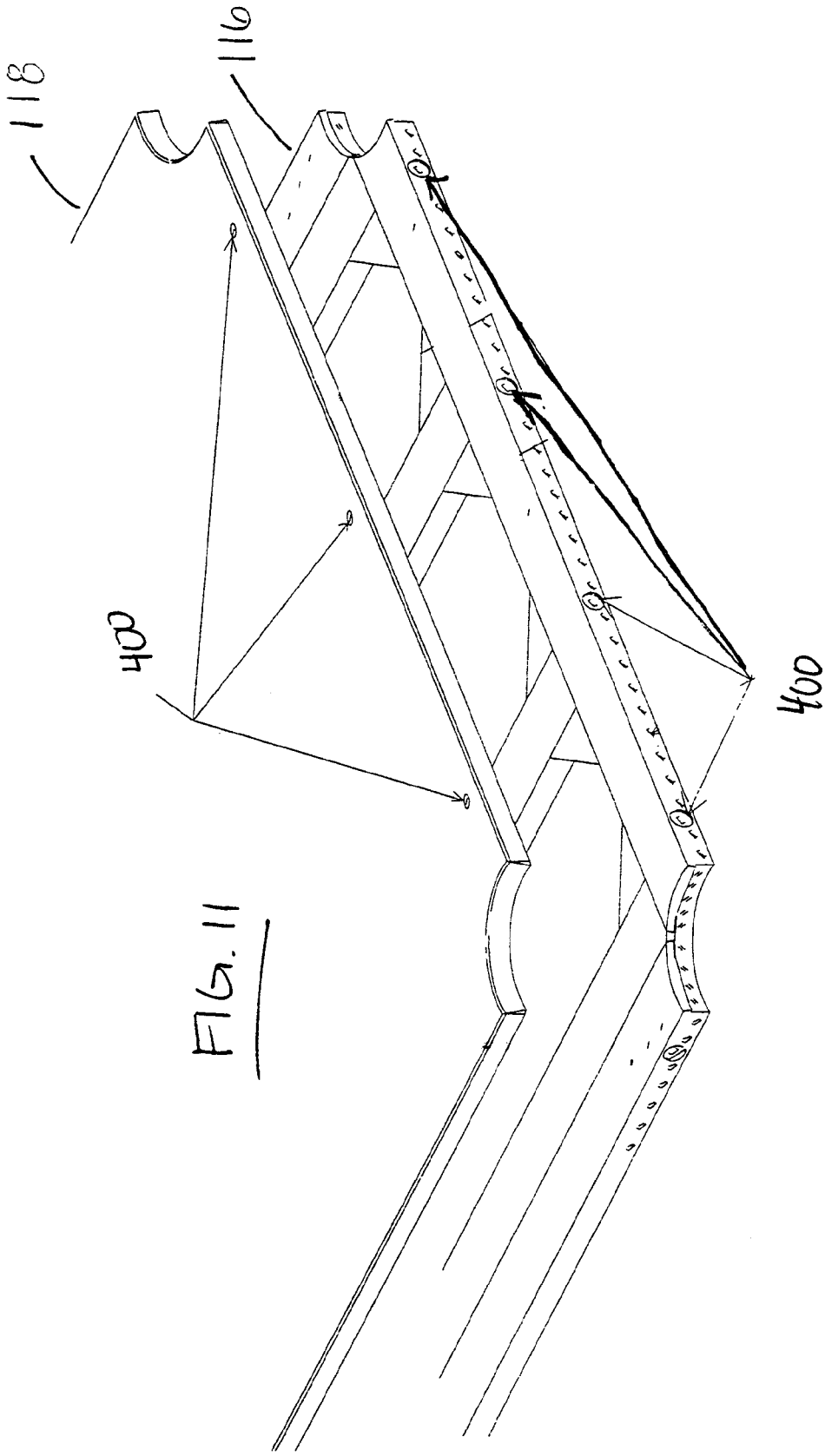
FIG. 11 is an exploded view of a pool table frame in accordance with an embodiment of the present invention.
Figure 12:
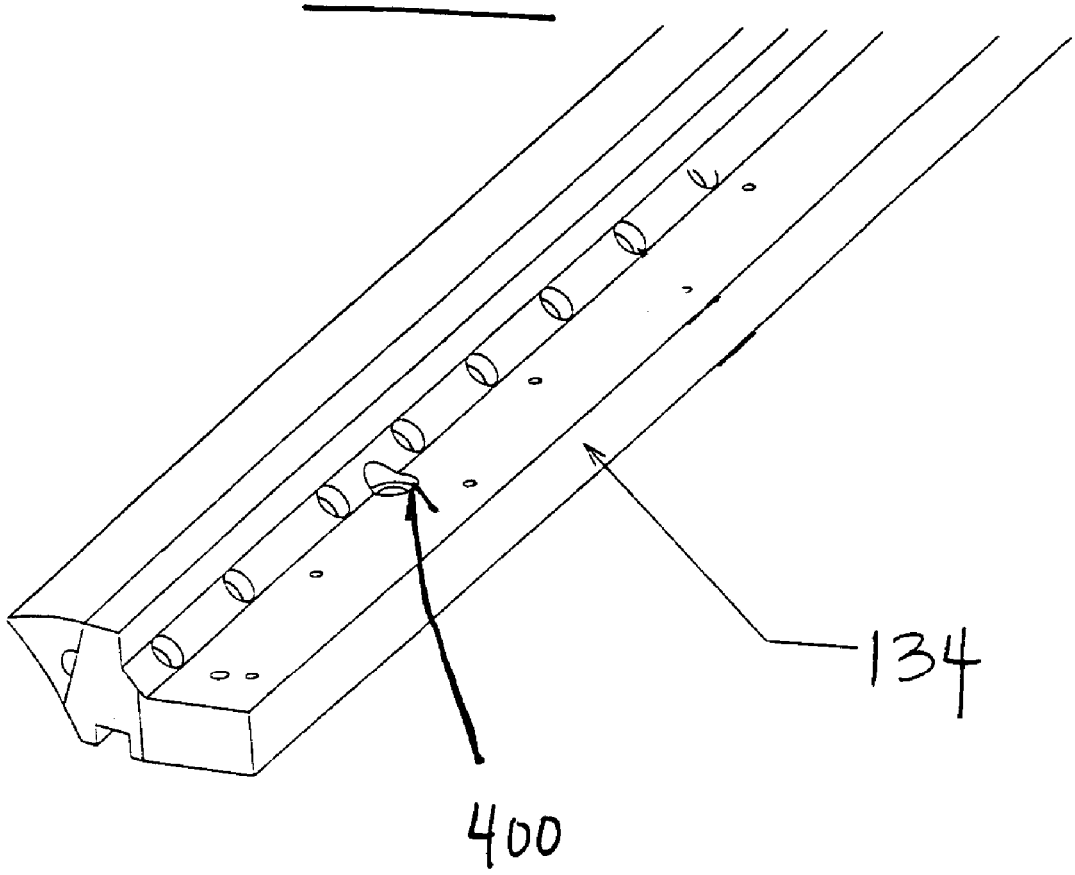
FIG. 12 is a perspective view of a cushion rail in accordance with an embodiment of the present invention.

Referring now to FIGS. 1, 11, and 12, the system of the present invention works as a result of accurately placed bolt holes 400 vertically through the slate 118 and slate frame 116, as well as horizontally through the use of a vertical sub rail 120 attached to the cap rail and cushion rail 134. Typically, vertical sub rails are not used when cushion rails are bolted through the slate of the tables. The present invention, however, uses vertical sub rails 120 in addition to the slate anchor bolts. This adds another direction of holding power for the cushion cap rail system. The holding power is created horizontally by bolting through the vertical sub rails 120 into special, tapered, self-tapping, threaded flanges that are installed into the slate frames 116. The threaded flanges are accurately adjusted during assembly of the pool table in the manufacturing phase to produce a bolt to foundation that properly locates and anchors the vertical sub rail 120. Thus, a solid bi-directional anchoring system is made preferably using seven bolts instead of the prior art three or four bolt, single directional bolting system used throughout the industry.

Because the threaded flange inserts locate the vertical sub rail properly, the cap rail system of the present invention is forced to locate properly in a repeatable fashion. The installation and assembly of the pool table is assured to be accurate with little effort, while the solid anchor of the cushion rails and cap rails are dramatically increased over prior art construction methods. This system allows non-professional installers to easily locate and bolt the pool table together with an extreme degree of accuracy. In addition, the degree of professionalism is greatly increased because of the bi-directional anchoring system preferably uses nearly double the bolt locations of a typical cushion bolt down system. The rebound of the balls on the pool table is enhanced by this system, and therefore is a welcome feature, as well as the fast set up that results from the factory alignment of the seven bolt, bi-directional anchoring system.

U-Shape, Structural Design

The present invention also provides a system for engineering the structural design of pool tables. The invention provides exceptional strength as well as quick and accurate assembly that permits KD ("knock-down") packaging to reduce shipping costs in each pool table.

Figure 13:
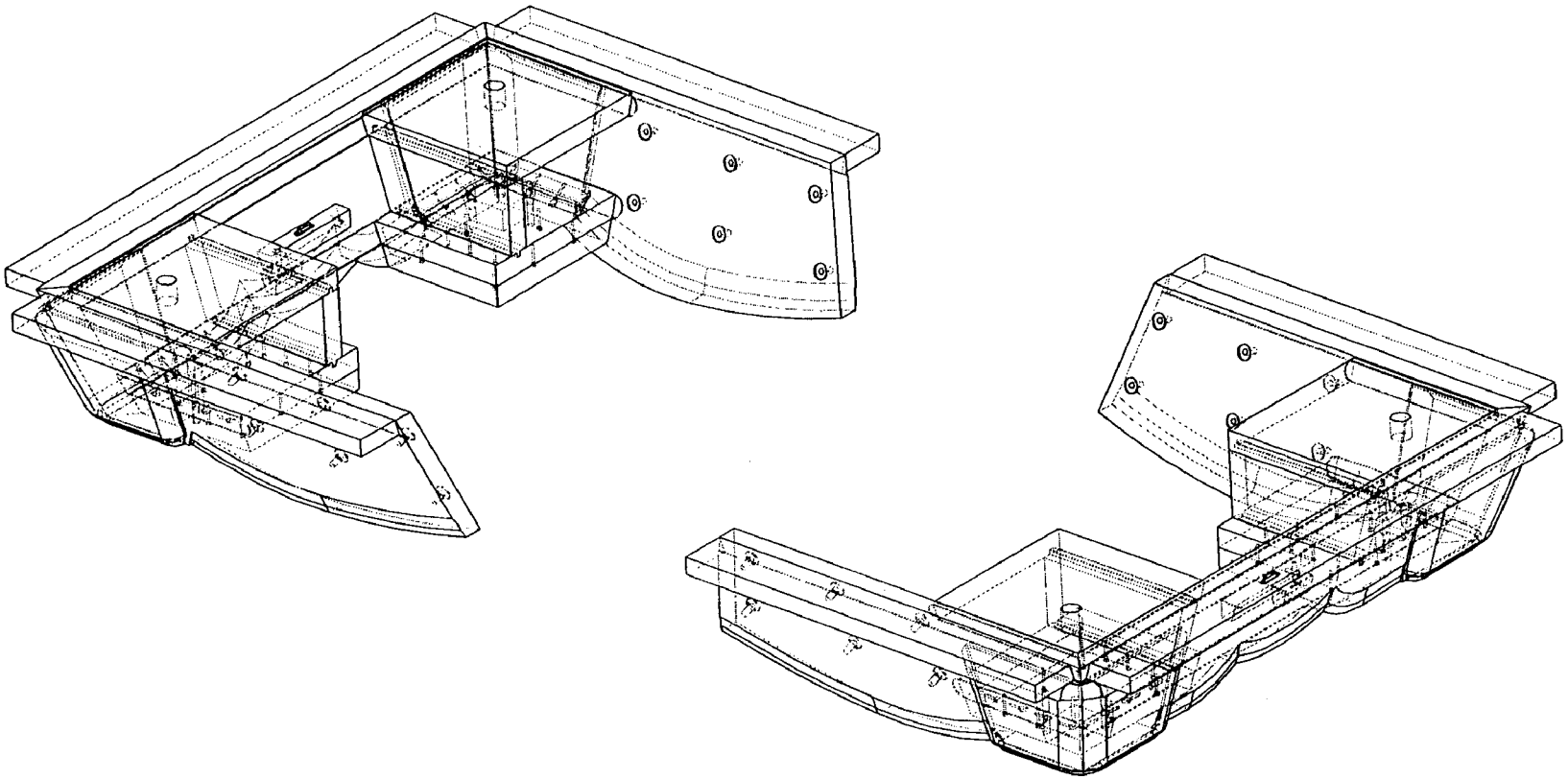
FIG. 13 is a perspective view of a two U-shaped ends of a pool table frame in accordance with an embodiment of the present invention.
Figure 4B:
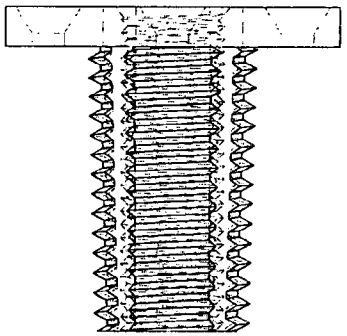
Figure 4C:
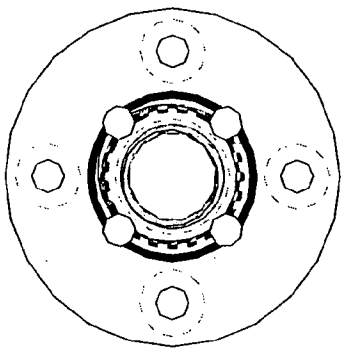
Figure 4A:
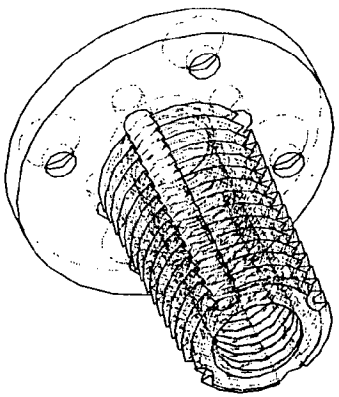

The two pool table U-shaped ends, as shown in FIG. 13, are significant to the pool table design of this embodiment of the present invention. This is because there is only a short center section of the pool table side base rail that is placed between the two U-shaped end sections of the pool table. The short side center base rails allow the U-shaped end sections to be short allowing for greater KD of the pool tables, while producing exceptional strength in the pool tables. In addition, this structural design features wooden I-beam engineered support beams to increase the rigidity of the pool table even more.

The structure of the pool table is preferably made by combining two separate U-shaped sections of the pool table. The two sections are simply the ends of the pool table along with a section of the side of the pool table set between the two end sections. The strength of the pool table comes from the use of three separate large sections of preferably laminated plywood, which are tenoned, glued, and screwed into the corners of the U-shaped pool table ends. The strength is incredible compared to prior art engineered pool tables even while the sections are disassembled.

This engineered design sets up a wedge action between the U-shaped end sections and the center section of the base of the pool table. This is much like a keystone in a doorway or bridge. The short side center sections of the base are fastened to an interior support beam that is itself bolted to the short side sections of the U-shaped end sections. These inside support beams are nested into each plywood corner section of the U-shaped section ends.

In addition to the support created by the wedge and the internal support beam, there are preferably two additional support I-beams that are bolted to each end of the plywood, U-shaped, inside, corner box sections.

The resulting pool table frame includes two U-shaped end sections, two center sections that are fastened to the U-shaped sections with an interior support beam, and two support I-beams that are secured to each end of the U-shaped sections. This U-shaped structural system provides massive strength in a pool table designed to be shipped KD, while requiring only a few minutes to assemble a highly accurate assembly in a repeatable fashion. Thus, the cost of the product to the customer is reduced because a professional installer is no longer needed to assemble a high strength pool table.

Tapered, Self-Tapping, Threaded Flange, Inserts

The present invention further includes an improved anchoring device for pool tables. This embodiment comprises a metal threaded flange used for bolting items to wood where high strength is required. The threaded flanges come in many sizes, from large to small. The flanges can be used to anchor to end grain of wood, which is extremely difficult, as well as to side grain of the wood.

As shown in FIGS. 14A–14C, the threaded flange of the present invention is threaded internally to accept a threaded bolt, while on the outside the threaded flange has tapered wood threads machined in such a way to create self-tapping threads. In addition, there are preferably four counter bores in the face of the threaded flange insert, which are used to wood screw the flange in place once it is threaded and epoxied in place. The wood screws add even more strength by wedging the wood of the end grain against the tapered wood threads of the threaded insert, and by gaining the strength of wood screws themselves.

The flanges are engineered to have vent holes allowing the use of epoxies to be used. The vent holes allow excess epoxy to escape, so the flange will seat properly without height issues. The epoxy glue adds to the holding strength of the flange as well by gluing the wood threads on the outside of the flange to the taped wood threads. Holes that are bored in the face for vents are also used as pin locations for special wrenches used to turn the threaded flange into the wood holes.

The flange works by gaining unequaled holding power in wood, side or end grain. The extremely strong anchoring system allows wood to be bolted together to get exceptional strength. The multiple ways the insert gains anchoring strength makes it extremely strong when glued and screwed into place. The self-tapping function helps gain strength, but also allows for self-centering of the threaded flange.

To use the flange, a hole is bored in wood where it is necessary to bolt to the wood. The hole size in the wood matches the required dimension of threaded flange. Then, a small amount of epoxy is put on the inside of the hole. The threaded insert is then turned into the hole until the proper depth is reached, or until the flange bottoms out against the face flange. Excess epoxy is then wiped away from the face of the flange. Lastly, wood screws are driven into the face of the flange through the countersink holes.

In the prior art production of pool tables, and other furniture-type items that require very high strength from wooden joints, especially end grain of the wood, it is nearly impossible to get strength in anchoring wood parts together. The threaded flanges of the present invention, however, are engineered to be the strongest fastener on the market. When the flanges are used, the wood joints become as strong as needed without any issues.

Slate and Frame Movement System

The present invention also addresses the difficult task of moving the heavy sections of slate into place while setting up a pool table and minimizing the health risks and damage to the slate while moving it to its final, exact, resting place on a pool table during the assembly of the pool table. This embodiment of the present invention makes this task much easier and more safe.

Each slate section of a pool table is large and weighs hundreds of pounds. This means that a huge amount of force must be used to move the slate even after the heavy slate section is placed onto the pool table. Prior art installation methods encounter the problem of how to use massive force to lift and move the heavy slate tiny distances in a controlled manner without damaging the delicate slate as it bangs into the slate setting next to it, or hurting the persons installing the slate. The present invention solves this problem by using multiple long wooden rollers, pry-bars, and engineered notches in the pool table cleat rails that allow the pool table to be moved tiny distances with ease and safety.

The wooden rollers are simply placed on the base of the pool table where the slate is to be placed. The slate is then lifted and placed on those rollers. Once the slate is on the rollers, it can be easily rolled to the approximate area it will be used.

Then the rollers are removed by using pry-bars to lift the slate were special notches are machined into the pool table base cleats. The rollers are slid out of each area while the slate is lifted away from the rollers by using the pry-bars. Once the rollers are removed from under the slate, the slate can be easily moved any short distance by rotating the pry bars in the notched out areas, while applying pressure to lift on the slate.

This embodiment of the present invention provides a significant advantage because prior art practices require the use of massive strength to slide the slate into position, which can be destructive and requires many individuals to participate in locating the slate. In addition, because the slate is so heavy, it is nearly impossible to move the slate tiny distances to achieve the best proper alignment.

This embodiment of the present invention, however, allows the slate to be placed exactly in the correct position with ease. Therefore, this new invention provides a significant improvement over the prior art because the exact placement of the slate is extremely important to achieve the proper dimensions of the playing field, and/or cap rail system.

In view of the foregoing, the present invention provides several improvements over prior art pool tables, pool table covers, and assembly thereof. Certain modifications and improvements will occur to those skilled in the art upon a reading of the forgoing description. All such modifications and improvements of the present inventions have been deleted herein for the sake of conciseness and readability but are properly within the scope of the present inventions.

What is claimed is:

1. A billiard table comprising:

a mainframe assembly;

a slate frame that is supported by the mainframe assembly, the slate frame comprising a plurality of first snap portions disposed on the perimeter of the slate frame;

a slate bed that is supported by the slate frame;

a cushion rail assembly that is supported by the slate bed, the cushion rail assembly also comprising a plurality of first snap portions disposed on the cushion rail assembly; and a table cloth comprising a plurality of second snap portions that are complementary to the first snap portions disposed on the slate frame and the cushion rail assembly;

wherein the table cloth is stretched prior to the second snap portions being disposed on the table cloth so that the second snap portions can be positioned on the table cloth to create an optimal tension in the table cloth when the table cloth is secured to the billiard table;

wherein the second snap portions on the table cloth align with and enter into a mating engagement with the first snap portions on the slate frame and the cushion rail assembly to secure the table cloth to the slate frame and the cushion-rail assembly; and wherein the mating engagement of the first and second snap portions is such that when the table cloth is removed from the billiard table such removal does not leave any holes in the table cloth, slate, slate frame, or cushion rail assembly.

2. The billiard table of claim 1 wherein the first snap portions on the cushion rail assembly are disposed on the inside and the bottom of the cushion rail assembly.

3. A method of manufacturing a billiard table having a removable table cloth cover comprising the steps of:

providing a mainframe assembly;

providing a slate frame assembly that is supported by the mainframe assembly;

providing a slate bed that is supported by the slate frame assembly;

providing a cushion rail assembly that is supported by the slate bed;

disposing a plurality of first snap portions on the slate frame;

disposing a plurality of additional first snap portions on the cushion rail assembly;

stretching a table cloth over the billiard table;

marking a placement of second snap portions that are complementary to the first snap portions on the table cloth to provide for optimal tension in the table cloth when the table cloth is secured to the billiard table;

disposing the second snap portions on the table cloth;

aligning the second snap portions on the table cloth with the first snap portions on the slate frame and the cushion rail assembly;

snapping the first snap portions and the second snap portions into a mating engagement to secure the table cloth to the billiard table; and removing the table cloth cover by unsnapping the first snap portions and second snap portions without leaving any holes in the table cloth, slate, slate frame, or cushion rail assembly.

* * * * *